United States Patent [19]

Stribling

[11] 4,166,421

[45] Sep. 4, 1979

[54] CYCLONIC FURNACE

[75] Inventor: John B. Stribling, Worcester, England

[73] Assignee: Heenan Environmental Systems Ltd., Worcester, England

[21] Appl. No.: 823,693

[22] Filed: Aug. 11, 1977

[30] Foreign Application Priority Data

Aug. 20, 1976 [GB] United Kingdom ..... 34776/76

[51] Int. Cl.[2] ..... F23G 5/12

[52] U.S. Cl. ..... 110/187; 110/171

[58] Field of Search ..... 110/171, 187, 244, 257, 110/259, 346

[56] References Cited

U.S. PATENT DOCUMENTS

| | | | |
|---|---|---|---|
| 1,659,564 | 2/1928 | Duncan | 110/257 |
| 1,973,705 | 9/1934 | Hardgrove et al. | 122/2 |
| 2,702,013 | 2/1955 | Atteberry | 110/259 |
| 3,141,426 | 7/1964 | Zachow | 110/187 |
| 3,411,465 | 11/1968 | Shirai | 110/346 |
| 3,457,883 | 7/1969 | Ankersen | 110/244 |
| 3,834,326 | 9/1974 | Sowards | 110/346 |
| 3,834,328 | 9/1974 | Blazewicz | 110/171 |
| 4,013,023 | 3/1977 | Lombana et al. | 110/187 |

*Primary Examiner*—Kenneth W. Sprague
*Attorney, Agent, or Firm*—Norris & Bateman

[57] ABSTRACT

Cyclonic furnace for efficient burning of such waste products as rubber tires or industrial or domestic refuse with minimum atmospheric pollution and high heat output has fixed circular hearth with central outlet for slag and ash discharge, material to be burnt being fed onto the hearth periphery; combustion air ports opening tangentially into its combustion chamber; and automatic control means regulating e.g. material infeed and inflow of combustion air including a facility for monitoring combustion conditions in the furnace, preferably by measurement of CO and $CO_2$ levels, and comparing those conditions with previously recorded conditions automatically to predict changes and make anticipatory adjustments of the furnace controls giving extremely rapid control reaction and enabling combustion air requirements to be cut to a minimum, of which the following is a specification.

17 Claims, 6 Drawing Figures

CYCLONIC FURNACE

This invention relates to furnaces, particularly for the combustion of waster products such as rubber tyres, waste oil and/or domestic or other refuse.

Many waste substances or by-products e.g. of chemical and petro-chemical processes, are unsuited by reason of their high calorific value, chemical analysis, and combustion characteristics for disposal in conventional furnaces and boilers. Such substances often require considerable expenditure in their disposal to avoid atmospheric pollution and other undesirable environmental effects, whereas could they be burnt efficiently and the heat produced be usefully recovered substantial savings would accrue, both in reduction of disposal costs and in replacing other fuels.

The use in such cases of cylindrical furnaces designed to give a spiral or cyclonic pattern to the combustion gases is already well known, but such furnaces are generally either severely limited as to the nature and physical form of the material which may be safely burnt with acceptable efficiency, smoke control etc; or alternatively, if they are designed to give little restriction on the nature of the materials to be burnt then they are large, complicated, and expensive as regards their mechanical and electrical construction so that the cost of installation and operation is high.

It is an object of the present invention to provide a furnace which is compact and simple in design, both mechanically and electrically, and at the same time is capable of consistent operation at high efficiency.

It is a further object of the invention to provide a means of disposal of high calorific value wastes and by-products of the rubber, chemical, petro chemical, and other industries at a much greater intensity of combustion than in most known types of equipment so as to substitute for the use of conventional and expensive fuels such as gas or oil.

According to one aspect of the invention there is provided a furnace comprising an operatively fixed circular hearth; a combustion chamber extending above the hearth and leading to an outlet flue; fuel burning means for pre-heating the furnace; at least one feed inlet for admitting material to be burnt to the combustion chamber; an outlet opening through the hearth for discharge of ash and slag; and at least one combustion air port opening tangentially into the chamber.

According to another aspect of the invention a method of burning high calorific value waste materials includes the steps of:

(a) feeding the material at a controlled rate onto the hearth of a preheated furnace having at least one tangential port while admitting a controlled flow of combustion air through said at least one port;

(b) sensing the combustion conditions within the furnace and applying integrated signals representing those conditions in to a logic system whereby they are compared with a series of preceding integrated signals stored in said system; and (c) automatically adjusting controls of the furnace to regulate at least the supply of combustion air to levels which anticipate changes in conditions predicted as a result of said comparison.

A preferred embodiment of the invention is now more particularly described with reference to the accompanying diagrammatic drawings wherein.

Figure 4A:
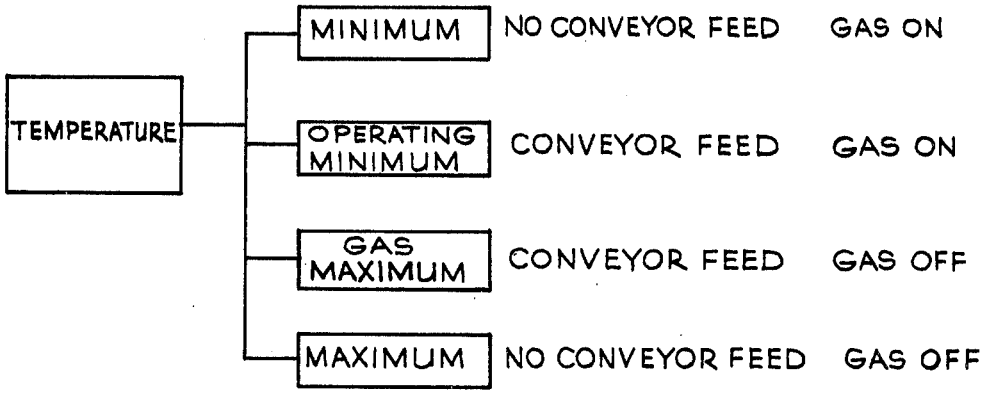
Figure 5:
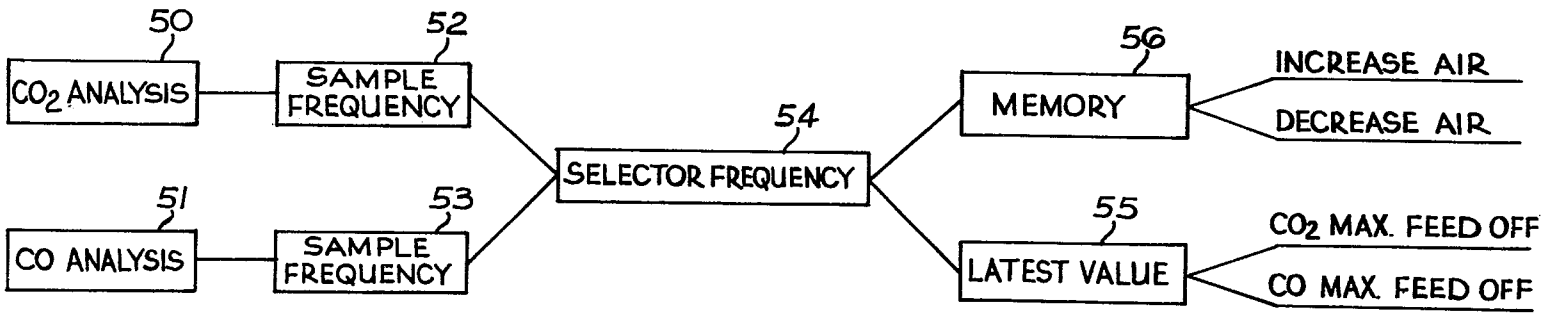

FIG. 4*a* and 4*a* are block diagrams showing control limit parameters of the furnace; and FIG. 5 is a block diagram of gas analysis responsive control means of the furnace.

The furnace comprises a cylindrical vertically disposed chamber 10 terminating at its upper end in a frusto-conical portion 12 leading to an exhaust flue 13. The bottom of chamber 10 is defined by a fixed hearth 14 heaving a central outlet orifice 11 for ash and slag discharge through a vertical inner steel tube 15 surrounded by a concentric outer shaped tube 16, the two being jointed by a top plate 17 to define an annular space 20. A water manifold 18 is located in the annular space between tubes 15 and 16 and fitted with a series of spray nozzles 19 to provide cooling within tubes 15 and 16 by evaporative means. Excess water drains from annular space 20 into a quench tank 21 in which the water level is maintained to form a seal at the lower end of tube 15.

The furnace has an outermost steel casing 9 lined with insulating material 22, and with an inner lining 23 of high grade refractory. Within this inner lining is a third or innermost refractory lining 24 of high grade alumina containing water tubes 25 to transfer heat from the furnace.

Hearth 14 is formed of the same material as lining 24 and is slightly dished in a frusto conical shape at 26. The alumina refractory extends to cover the annular top plate 17 around central orifice 11. In this construction water tubes 25 do not extend into the central annular area of the hearth and cooling takes place here only by the evaporative means beneath top plate 17. The refractory material above plate 17 is allowed to melt or be dissolved by chemical and thermal action of molten slag in the furnace during operation until a point of equilibrium is reached and dissolved refractory is replaced by solidified cooled slag which then itself forms a new refractory protection for the steel plate 17. In a modified construction the whole hearth is cooled by water tubes 25, and the outer tube 16 and evaporative cooling manifold 18 and nozzle 19 are dispensed with.

Figure 2:
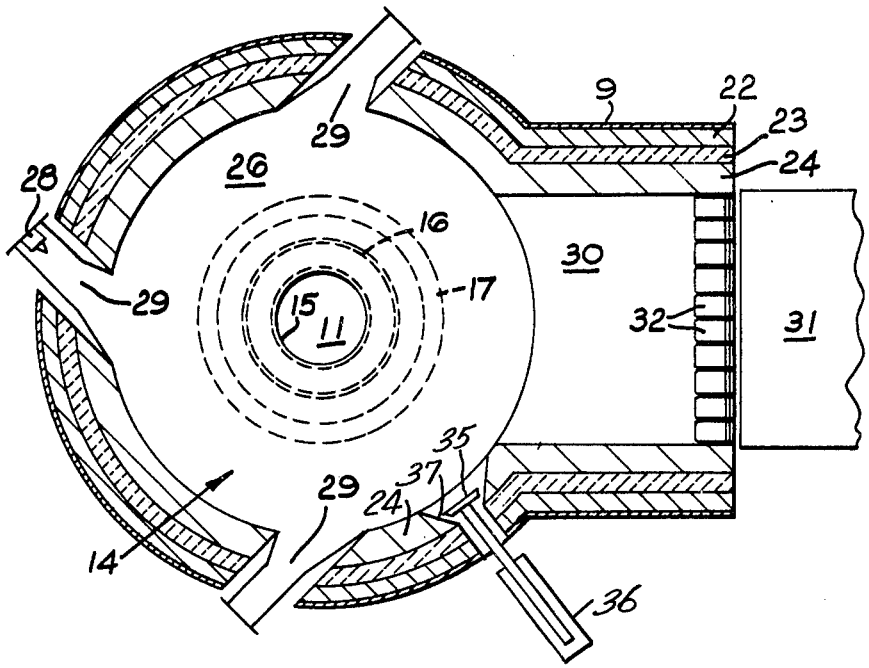
FIG. 2 is a sectional plan view on line II—II of FIG. 1.

At least one, and preferably a series of inlet ports 29 are arranged tangentially (FIG. 2) to a lower region of chamber 10, at an angle slightly inclined from the horizontal. One of said ports mounts a gas or fuel oil burner 28 for preheating the furnace, and ports 29 have ductwork connections for controlled admission of air from a forced draught fan (not shown).

The material to be burnt(in this case waste rubber tyres) is admitted through a refractory lined and water cooled furnace vestibule 30. Movement of the waste tyres into the furnace is provided by feed means in the form of a variable speed conveyor belt 31 and excessive uncontrolled ingress of air around the feed is prevented by a series of water-cooled hanging segmented slats 32 at the mouth of vestibule 30 designed to remain in the closed position unless pushed aside by entry of material. Belt 31 will carry two rows of tyres side by side, the mass of tyres on the belt pushing those leaving the belt into the furnace and across the hearth until they have been burnt.

To make even more efficient use of the available furnace volume the rate of feed of tyres (or similar objects to be burnt) through vestibule 30 can be increased by providing a second conveyor belt spaced above the outfeed end of belt 31 acting as a blanket conveyor, automatically driven at the same controlled speed as belt 31 and with automatic adjustment of the spacing between the belts to form a nip for more positive urging of the tyres or other objects through slats 32 into the furnace. In this way tyres may be stacked on the conveyor two deep as well as in two rows so that four tyres at a time pass into the furnace giving greater heat output for a given volume of furnace.

A second feed inlet or vestibule with associated feed means may be provided at an angle of 120°-180° to the vestibule 30, especially where the hearth area is large so that the latter is more fully utilised.

If other types of waste material are to be burnt other forms of controlled feed means may be used, e.g. a screw conveyor with variable speed drive for oil sludges; a pipe feed with variable speed pump for liquids; or a pneumatic pusher system through an airlock vestibule for scrap butyl rubber or other bulk material. In each case the waste material is deposited near the periphery of hearth 14, and the rate of operation of the feed means is controlled automatically by the function of the required furnace heat output as measured by a control system.

If the material is a liquid or where the inert residue of combustion of the material is wholly or partly liquid, the whole area of hearth 14 may be dished to drain the residue into the orifice 11. If the residue remains solid a radially outer annular part of the hearth may be flat, with a dished inner annulus, and a pneumatically operated water cooled plough 35 can be provided to move such solid material as remains on the hearth into tube 15 so that is drops into quench tank 21 for subsequent disposal. The pneumatically operated water cooled plough 35 is normally withdrawn into a recess 37 of the inner refractory lining 24. Means for extending the plough towards the central discharge 11 is provided by the pneumatic cylinder assembly 36. A second plough if required may be positioned radially on the opposing side of the furance adjacent to the tyre inlet.

As the result of the tangential arrangement of inlet ports 29 a cyclonic spiral gas pattern is produced in chamber 10 above the waste material in combustion upon hearth 14, resulting in the separation of the hottest gases by centrifugal action, so that the centre and a variable proportion of the remainder of the volume of the whole furnace is filled with a rapidly rotating vortex or column of flame, and the final gaseous products of substantially complete combustion leave the exhaust flue 13, from which they may pass to a heat exchanger or preferably a firetube or water tube boiler (not shown).

Figure 1:
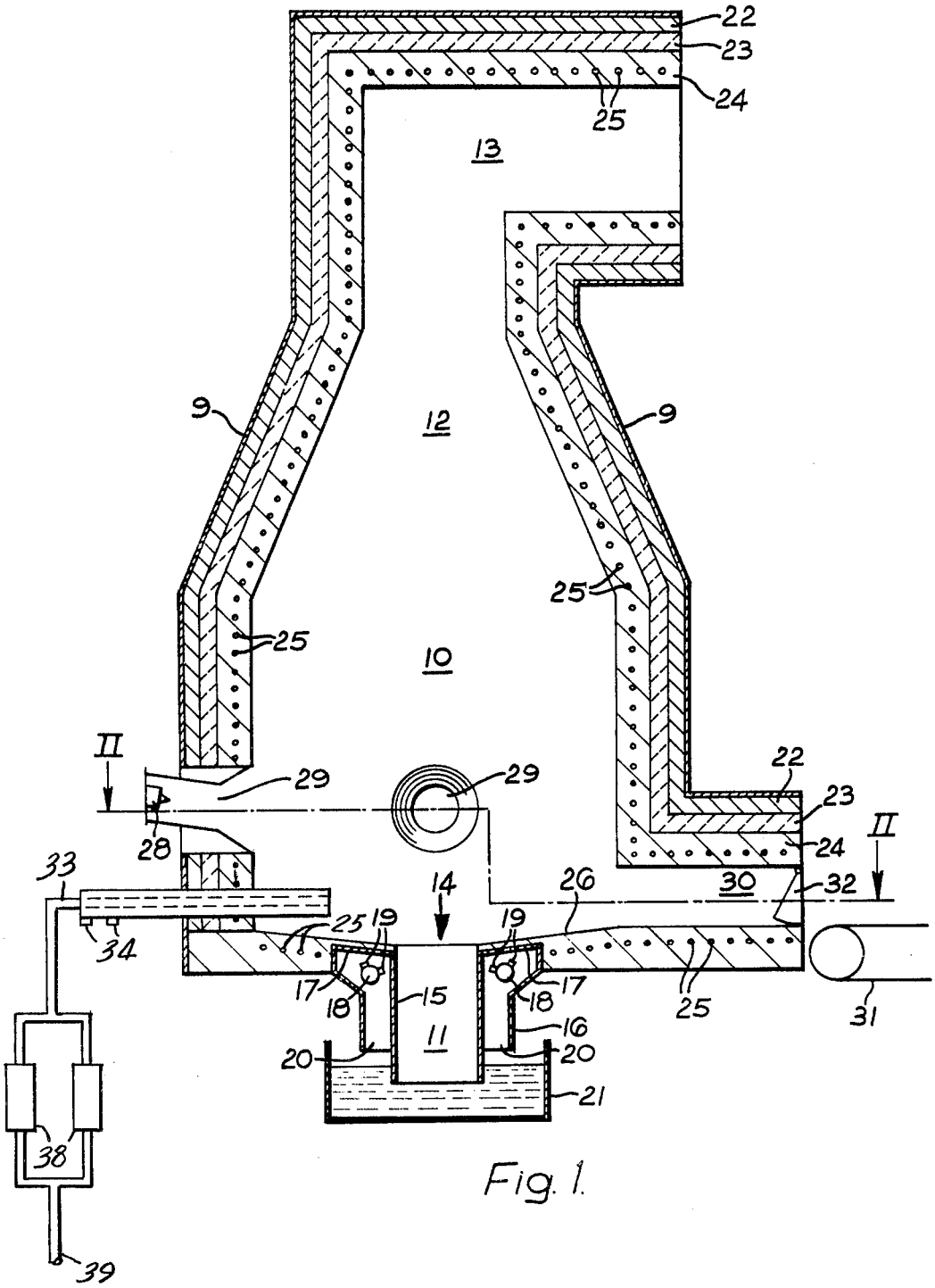
FIG. 1 is a vertical section of a furnace.

In some cases there may be carbon, mainly in graphitic form, in the central vortex region of the furnace during combustion and a lack of sufficient oxygen at hearth level to oxidise this. A steam injector may be provided at or near the centre of hearth 14, so that injected steam will react with the carbon at the high operating temperatures in this region to form water gas (mixture of H and CO) which combines with oxygen higher in the furnace, so further increasing effective use of the furnace. A catalyst such as MISCHMETALL may be used in conjunction with the steam injection to facilitate chemical breakdown of gases and liberation of free hydrogen. As shown in FIG. 1 steam injector means 33 is located near hearth level and protected against furnace temperature by an outer water cooled jacket 34. Steam supply 39 for the injector may be made to pass through one of the containers 38 which contains the catalyst, provision being made for change of catalyst or for cleaning by use of the second container 38 while the equipment is still working, each container being provided with isolating valves.

The furnace includes an automatic control system which is now discussed in more detail with reference to FIGS. 3-5.

It is a characteristic of many high calorific value waste materials that the rate of combustion is so rapid, and combustion itself can commence at such a low temperature, as to be virtually uncontrollable, with resulting inefficiency, production of black smoke, and danger of explosion, unless the furnace in which they are burnt is capable of equally rapid control reaction as regards rate of fuel feed, rate of air supply, pressure of gaseous products of combustion, and temperature of the furnace interior. Empirical rules for furnace dimensions, operation and control which have been largely based in the past on the use of carefully graded coal or oil fuels, have little relevance to the handling of waste materials having combustion rates which are much faster and liable to fluctuation due to variations in composition.

The use of a cyclone furnace is already known as a means of containing combustion of high calorific materials so that variations in pressure do not have the deleterious effect that might occur in other forms of furnace; but hitherto, it is believed, a furnace control system has not been successfully provided to govern such rapid oxidation, since conventional controls have been found incapable of sufficiently fast speed of reaction. Attempts have been made to achieve a stable efficient rate of operation of a cyclone furnace but within certain pre-set limits only. The present control system is intended to achieve controlled combustion wholly automatically by sensing conditions and using the readings continuously to predict in advance what changes will take place in the rate of oxidation so as to enable the furnace to operate under more efficient conditions than other types of control can achieve. This is achieved by using sensors connected to a logic circuit and making adjustments to the individual furnace controls accordingly. In addition to the normal operating parameters necessary to the safety of any furnace and boiler plant the main sensors would indicate:

(a) Positive pressure of forced draught fan air at fan outlet (b) Negative pressure of forced draught fan air at fan inlet (c) Negative pressure of induced draught fan air at fan inlet (d) Positive pressure of induced draught fan air at fan outlet (e) Relative pressure of boiler between combustion gas inlet and outlet.

(f) Relative pressure of furnace between combustion air inlet and combustion gas outlet.

(g) Combustion gas temperature at inlet to boiler (h) Combustion gas temperature at outlet to boiler (i) Carbon dioxide content of combustion gas at induced draught fan inlet (j) Carbon monoxide content of combustion gas at induced draught fan inlet (k) Oxygen content of combustion gas at induced draught fan inlet (l) Boiler steam pressure or hot water pressure.

Figure 3:
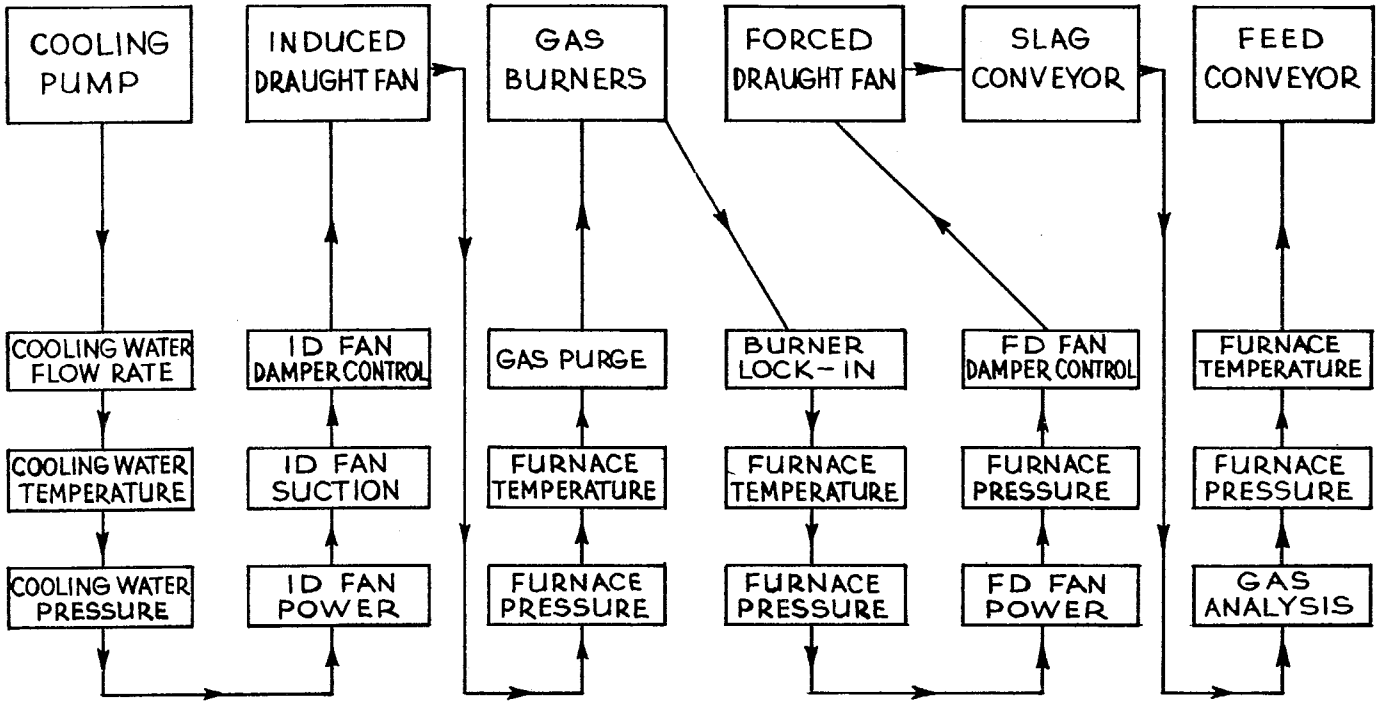
FIG. 3 is a block diagram showing the main function control sequence of the furnace.
Figure 4B:
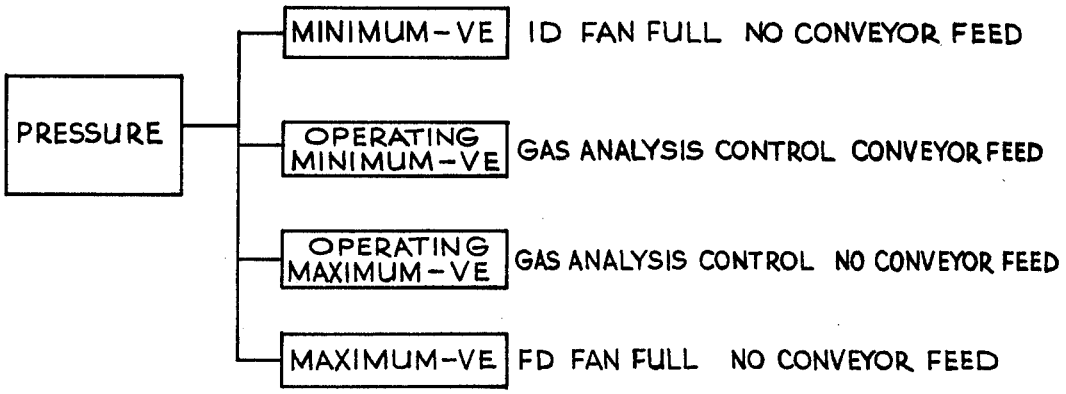

FIG. 3 shows the items involved in, and the order of sequence of the main function controls of the furnace for automatic starting involving those sensors whose readings must be satisfactory before the sequence proceeds. FIGS. 4*a* and *b* show control limit parameters giving operation of plant in response to preset sensor values.

The essence of a static logic diagram relating sensors with the subsequent operation of the various furnace controls is the comparison of the indications of the various sensors not only one with another but also with their preceding and subsequent indications. The object is to provide a method whereby the speed of reaction of the combustion of the material inside the furnace is matched or anticipated by a logic prediction based upon the change in individual and related readings in unit increment of time, thus providing a control of reactions which are too rapid for control by individual conventional instruments.

It must be remembered that all furnaces and boilers operate by use of a quantity of air for combustion which is at all times in excess of that stoichiometric figure normally necessary for complete oxidation of the constituents of the fuel. This excess, which may vary from 10% to several hundred percent, depending on the nature of the process, is really a measure of the inefficiency of the combustion unit. That is to say, sufficient additional air is allowed in the process to ensure that variations in combustion rate or delays in provision of information by control instruments do not unbalance the whole process, leading either to black smoke, incomplete combustion, drop in temperature, or danger of blowback or explosion. The excess air is wasteful as it has to be handled through the system (with additional power costs and increase in capital costs as equipment has to be large enough to take it) and it makes the final temperatures lower.

The ratio of carbon monoxide produced to oxygen absorbed can be equated to the intensity of the combustion process under controlled standard conditions. In turn, the carbon dioxide produced can be related to the oxygen absorbed, so that an empirical relationship can be found between changes in carbon monoxide and carbon dioxide concentration. If these values are examined on a time basis by use of static logic modules the individual analysis obtained can be considered as differentials on a time base curve, and an integration made to predict the performance of the combustion process within a predetermined time from the point of analysis. This allows control of the ultra-rapid oxidation processes of high calorific value fuels to give lower excess air than is possible with existing apparatus.

FIG. 5 shows gas analysis responsive control means using a solid state logic system for this purpose. Infra red $CO_2$ and CO analysers 50, 51 feed signals continuously through respective infinitely adjustable preset sample frequency circuits 52, 53 giving adjustable intervals in analysis readout and providing differentials for memory storage. These signals then pass through an infinitely variable selector circuit 54 which selects alternately CO and $CO_2$ readings to store in solid state switchgear, either for immediate control in a "latest state" circuit 55 in the case of maximum values, or for comparison with previous integral signals stored in memory circuit 56 to continuously control the combustion air. In this way rates of change of $CO_2$ and CO are measured repeatedly within fractions of a second and are compared to build up an integral signal from the series of individual or differential signals, said integral signal being stored and available for comparison with later integral signals for use in speedy adjustment of the furnace controls in advance of anticipated conditions. Excess air can thus be reduced much below presently accepted practice, maybe as little as 5% excess air being required giving an intensity of heat release easily ten times that of conventional grate furnaces.

While monitoring of the CO and $CO_2$ levels is preferred as a way of sensing combustion conditions other factors thereof might be sensed as well as or instead of these levels; and used to control other aspects of operation of the furnace on an anticipating basis as well as the combustion air.

The control system in combination with the cyclonic gas pattern and provision for water cooling enables very rapid combustion to be achieved, such that a rubber tyre for instance can be oxidised to a temperature at which the steel frame of the carcass will melt within forty seconds of entry into the furnace.

The arrangement of water tubes inside the furnace lining may be modified together with the addition of further sensors:

(m) Furnace shell cooling water inlet temperature.

(n) Furnace shell cooling water outlet temperature.

(o) Furnace shell cooling water differential pressure.

(p) Furnace shell cooling water absolute pressure, to enable high pressure hot water or steam to be generated within the furnace structure itself without a separate steam or hot water boiler.

Having now described my invention:

1. A furnace comprising an operatively fixed circular generally level hearth; a combustion chamber extending above the hearth and leading to an outlet flue; at least one feed inlet for admitting solid or liquid waste or other material to be burnt into the combustion chamber and onto said hearth, said material feed inlet being provided with means resisting inflow of air therethrough; an outlet opening through the hearth for discharge of ash and slag also provided with means resisting inflow of air therethrough; whereby no significant amount of air is permitted to enter through said material feed inlet or said outlet opening; at least one combustion air port opening tangentially through the chamber periphery substantially above the levels of the hearth and said feed inlet and downwardly directed toward the hearth for the controlled admission of combustion air in a path which will create a vortex flow within the combustion chamber above the material burning on the hearth in use; a furnace preheater positioned in the chamber periphery above said hearth operated only for preheating the furnace; and means connected to sensor means in the combustion chamber responsive to the operating temperature of the furnace when burning said material for controlling admission of fuel feed to said preheater and admission of combustion air.

2. The furnace defined in claim 1, wherein there are a plurality of said combustion air port openings, and said furnace preheater is disposed in one of them.

3. A furnace according to claim 1 wherein the furnace structure includes heat transfer means for absorbing and transferring heat from said structure by a fluid medium.

4. A furnace according to claim 3 wherein said heat transfer means comprises water tubes incorporated in a refractory lining of the combustion chamber.

5. A furnace as defined in claim 1 wherein said hearth and combustion chamber are lined with a refractory that melts or similarly changes its physical structure when subjected to a combustion chamber temperature exceeding a predetermined value, and such lining contains passages for circulating cooling fluid whereby the refractory lining may be reformed in situ.

6. A furnace according to claim 1, wherein the outlet opening is defined by a pair of concentric tubes, an annular space between the tubes incorporating evaporative spray cooling means for said tubes.

7. A furnace according to claim 1 including feed means for conveying the material into the feed inlet.

8. A furnace according to claim 7 wherein said feed means comprises at least one variable speed conveyor belt.

9. A furnace according to claim 1 wherein said means restricting an inflow at the feed inlet comprises hanging closure means which is pushed aside by entry of the material to be burned.

10. A furnace according to claim 1 wherein at least a central annular area of the hearth surrounding the outlet opening is dished.

11. A furnace according to claim 1 including a plough for urging solid material on the hearth towards the outlet opening.

12. A furnace according claim 1 including steam injection means operating in the region of the hearth level.

13. A furnace according to claim 12 including the provision of a catalyst in conjunction with said steam injection means.

14. A furnace according to claim 1 including control means for sensing operative conditions in the furnace and regulating at least the combustion air supply in accordance with said conditions so as to maintain substantially complete combustion continously.

15. A furnace according to claim 14 wherein said control means also regulates feed of material to be burnt through said feed inlet into the furnace and the residence time thereof in the furnace.

16. A furnace according to claim 14 wherein said control means includes a sensor for sensing combustion conditions within the furnace and providing signals representing those conditions, a logic system whereby said signals can be stored and compared with at least one preceding signal stored in said system, and means responsive to said comparison for automatically adjusting controls of the furnace to regulate at least the supply of combustion air in anticipation of changes in said conditions predicted as a result of said comparison.

17. A furnace according to claim 16 wherein said sensor monitors the levels of carbon monoxide or carbon dioxide or both in the furnace.

* * * * *